US006247399B1

(12) United States Patent
Yoshida

(10) Patent No.: US 6,247,399 B1
(45) Date of Patent: Jun. 19, 2001

(54) PRESS MACHINE

(75) Inventor: Akihiro Yoshida, Gifu-ken (JP)

(73) Assignee: K.K. Yamada Dobby (JP)

( * ) Notice: Subject to any disclaimer, the term of this patent is extended or adjusted under 35 U.S.C. 154(b) by 0 days.

(21) Appl. No.: 09/333,719

(22) Filed: Jun. 15, 1999

(30) Foreign Application Priority Data

Mar. 24, 1999 (JP) ..... 11-079539

(51) Int. Cl.[7] ..... B30B 5/00
(52) U.S. Cl. ..... 100/257; 100/282; 72/450
(58) Field of Search ..... 100/257, 282, 100/285, 281, 292, 283; 72/450, 451; 83/626; 74/40

(56) References Cited

U.S. PATENT DOCUMENTS 5,287,728 * 2/1994 Yoshida ..... 74/40
5,317,893 * 6/1994 Eigenmann et al. ..... 100/257
5,746,123 * 5/1998 Eigenmann ..... 100/257
5,848,568 * 12/1998 Imanishi ..... 100/257

FOREIGN PATENT DOCUMENTS 09225686 9/1997 (JP) .

* cited by examiner

*Primary Examiner*—Ira S. Lazarus
*Assistant Examiner*—Louis K. Huynh
(74) *Attorney, Agent, or Firm*—ipsolon llp

(57) ABSTRACT

A press machine includes upper and lower slides respectively attached to upper and lower portions of posts movable in the up and down directions; a link mechanism having first and second levers connected with each other to cause bending and stretching motion, one lever having a first fulcrum connected with a frame, and the other lever having a second fulcrum connected with the lower slide, a connecting mechanism for connecting a crankshaft with the link mechanism such that the first and second levers are bent and stretched as the crankshaft is rotated; and an adjusting device for connecting with the link mechanism or the connecting mechanism such that the range of the bent angle made by the first and second levers can be adjusted.

13 Claims, 9 Drawing Sheets

PRESS MACHINE

BACKGROUND OF THE INVENTION

1. Field of the Invention

The present invention relates to a press machine in which a slide is driven from its downside so as to move in the up and down direction.

2. Prior Art

As one of press machines, there is an underdrive press machine such as a dieing press machine, of which the slide is driven from the downside through a link mechanism associated with the driving means. This press machine is constructed such that the rotary motion of a crankshaft rotated by a driving source is once converted into a reciprocating motion with the help of a link mechanism such as a knuckle joint, a toggle joint and so forth, whereby a slide is correspondingly reciprocated by the converted motion in the up and down directions over the link mechanism.

In the prior press machines of this kind, however, the stroke of a slide motion in the up and down directions is limited to a preset value determined according to the sorts of press processings such as the precise press processing (low speed press processing), the stamping processing (high speed press processing) and so on.

Consequently, in the prior art press machine of this kind, the stroke of the slide can not be changed, so that the applicable range of the press machine has been limited by such limited stroke of the slide.

Therefore, in the press machine of this kind, it is important that the stroke of its slide motion in the up and down directions be made variable.

SUMMARY OF THE INVENTION

According to the invention, there is provided a press machine which includes a frame; a plurality of posts movably extending in the up and down directions; an upper slide fitted to the upper end portions of the posts; a lower slide fitted to the lower end portions of the posts; a crankshaft rotated by a driving source; a link mechanism having first and second levers connected with each other so as to perform bending and stretching motions so that the lower slide may move vertically, one of the levers having a first fulcrum connected with the frame, the first fulcrum being not moved by the bending-stretching motion, and the other lever having a second fulcrum connected with the lower slide, the second fulcrum being moved by the bending-stretching motion; a connecting mechanism for connecting the crankshaft with the link mechanism such that the first and second levers are bent and stretched as the crankshaft is rotated; and an adjusting device for connecting with the link mechanism or the connecting mechanism so as to adjust the range of the bent angle made by the first and second levers.

The first and second levers are bent and stretched by the connecting mechanism as the crankshaft is rotated. As the first and second levers are bent and stretched, this bending-stretching motion of the first and second levers is transmitted to the lower slide, and a plurality of posts come to be reciprocated in the up and down directions along with the reciprocating motion of the lower slide. Thus, the upper slide to which the die is attached comes to be reciprocated in the up and down directions above the lower slide.

As the bent angle (the range of bending-stretching angle) is changed by the adjusting device, the interval between the first and second fulcrums of the link mechanism is correspondingly changed, and thus, the range of the up and down motion of the lower slide and posts are changed in correspondence therewith. As a result, the stroke of the up and down motion of the upper slide is varied.

As described above, in the press machine of the type wherein the slide is driven from its lower side, if there is provided such an adjusting device as can adjust the range of the bending-stretching angle of the first and second levers, the stroke of the up and down motion of the upper slide can be made variable in compliance with the sort of press processing.

The adjusting device may be provided with a circular plate-shaped rotating body rotatable about an axis extending in one direction, the rotating body having a threaded hole; a rotating mechanism for rotating the rotating body; and a moving body having a male screw portion mating with the threaded hole and connected with the link mechanism or the connecting mechanism. With the adjusting device constituted as above, as the position of the moving body in one direction can be finely adjusted, it becomes possible to finely adjust the stroke of the up and down motion of the upper slide.

However, the adjusting device may be constituted to include a rotating body pivotally connected with the link mechanism or the connecting mechanism, a pivotal joint to the link mechanism or the connecting mechanism being movable about an axis extending in one direction, and a rotating mechanism for rotating the rotating body. With the adjusting device constituted as such, the pivotal joint is displaced as the rotating body is rotated with the rotating mechanism, thus enabling the stroke of the up and down motion of the upper slide to be finely adjusted.

The connecting mechanism can be provided with third and fourth levers connected with each other so as to be bent and stretched, one of the levers being connected with the adjusting device; a connecting rod for connecting the eccentric shaft portion of the crankshaft with the other of the third and fourth levers such that the third and fourth levers are correspondingly bent and stretched as the crankshaft is rotated; and fifth lever connecting the third and fourth levers with the link mechanism such that the first and second levers are correspondingly bent and stretched as the third and fourth levers are bent and stretched. With the connecting mechanism as constituted as above, when the position of the joint between one of the third and fourth levers and the adjusting device is changed relative to the frame by the adjusting device, the range of the bending-stretching angle of the first and second levers is changed, whereby the stroke of the up and down motion of the upper slide is changed correspondingly.

The connecting mechanism may further include a slider arranged on the frame such that it can move in a reciprocating fashion and is connected with the joint between the connecting rod and the other of the third and fourth levers. As the slider serves to limit the moving direction of the joint between the connecting rod and the other lever of the third and fourth levers, thereby allowing the link mechanism to exactly bend and stretch.

The adjusting device may include a rotating body pivotally connected with the link mechanism or the connecting mechanism, and a rotating mechanism for rotating the rotating body. The connecting mechanism may include third and fourth levers connected with each other so as to be bent and stretched, at least one of the levers being pivotally connected with the rotating body; a connecting rod for connecting the eccentric shaft portion of the crankshaft with the other of the third and fourth levers such that the third and fourth levers are correspondingly bent and stretched as the crankshaft is rotated; and fifth lever connecting the third and fourth levers with the link mechanism such that the first and second levers are correspondingly bent and stretched as the third and fourth levers are bent and stretched; wherein the rotation center of the rotating body is located at the joint center of the third and fourth levers or at a point in the vicinity of or apart from the joint center.

In such a situation as the rotating body is connected with the joint between the third and fourth levers or with a point in the vicinity thereof and the slide is set on the position of the lower dead point, if the rotating body is angularly rotated by the driving mechanism, the rotating body is angularly rotated about the joint between the third and fourth levers or about a point in the vicinity thereof, thereby changing the bent angle (the range of bending-stretching angle). With this, the swinging position and swinging angle of the third and fourth levers are changed as they are bent and stretched in correspondence with the rotation of the crankshaft. However, hardly any change is caused not only in the position of the joint between the third and fourth levers but also in the position of the lower dead point of the slide. As a result, it becomes possible not only to finely adjust the stroke of the slide motion in the up and down directions but also to keep the position of the lower dead point almost unchanged when the stroke is changed.

Contrary to this, in case the rotating body is connected with a point apart from the joint between the third and fourth levers, if the rotating body is angularly rotated by the rotating mechanism, the rotating body is angularly rotated about a point apart from the joint between the third and fourth levers, and the joint between the rotating body and the connecting mechanism comes to angularly move in the identical or opposite direction. As a result, it becomes possible not only to finely adjust the stroke of the slide motion in the up and down directions but also to make the positional change of the lower dead point smaller when the stroke is changed.

The link mechanism can be arranged such that the first and second fulcrums or fulcrums are spaced out in the up and down directions. In this case, it is possible to set the first fulcrum above the movable one, and also to set the joint between one of the third and fourth levers and the adjusting device above the joint between the other of the third and fourth levers and the connecting rod.

The press machine further may include a bolster set up in the middle portion of the frame in view of its height.

The rotating body of the adjusting device is constituted with a worm wheel while the rotating mechanism is constituted with a worm in mesh with the worm wheel.

PREFERRED EMBODIMENT OF THE INVENTION

Figure 1:
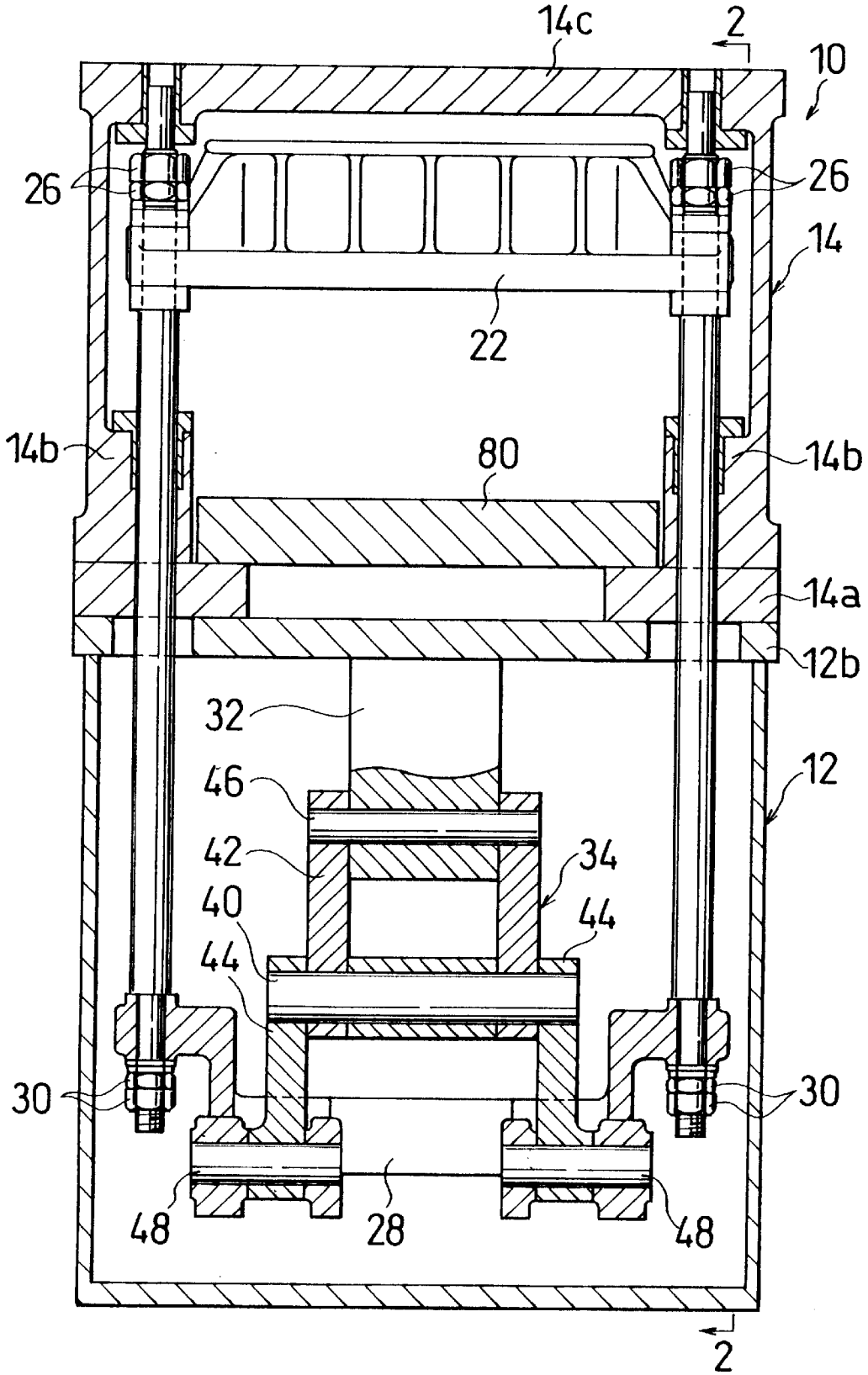
FIG. 1 is longitudinal sectional view of a press machine according to the invention.
Figure 2:
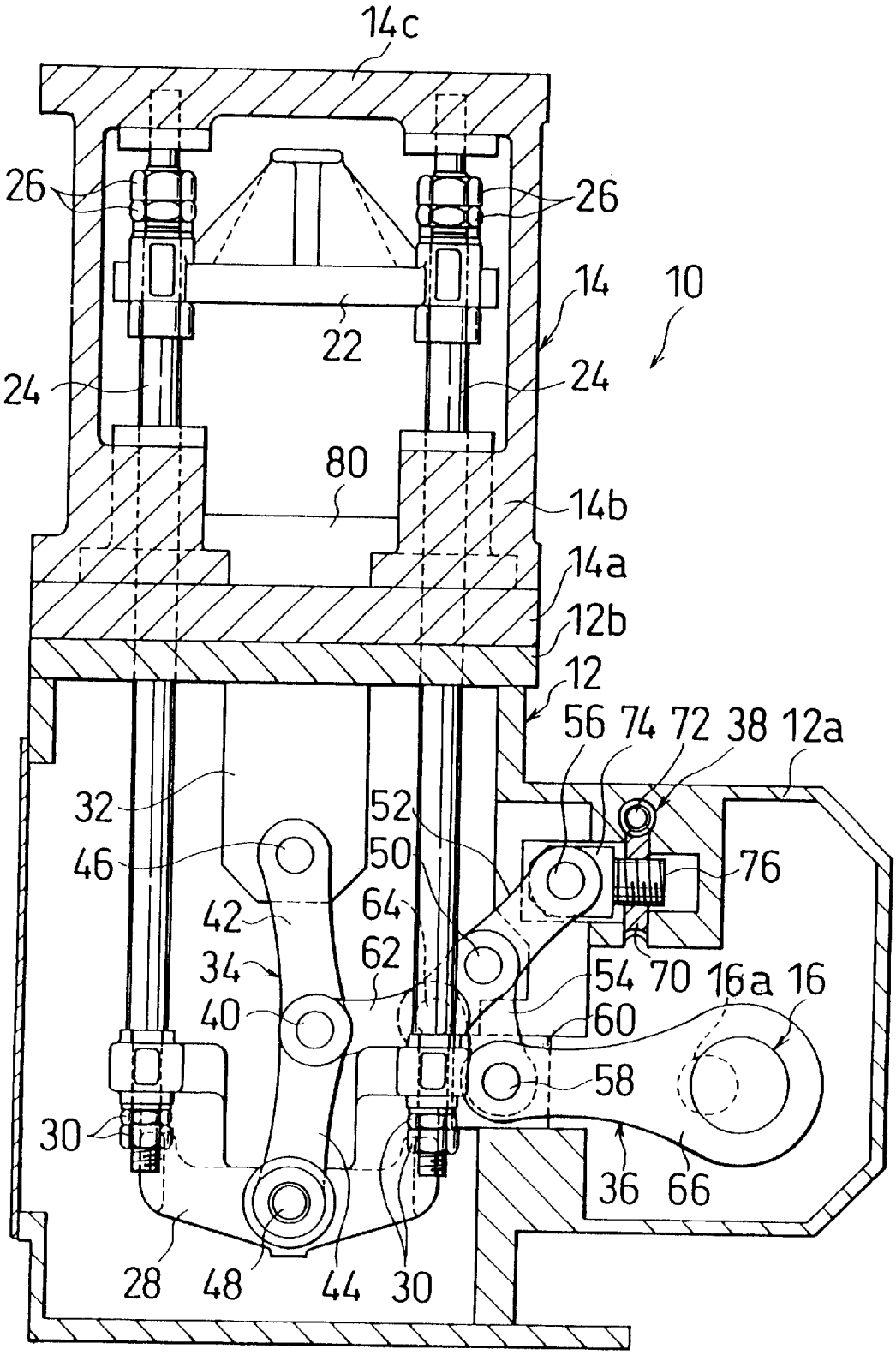
FIG. 2 is a sectional side view of the frame in part of the press machine shown in FIG. 1.
Figure 3:
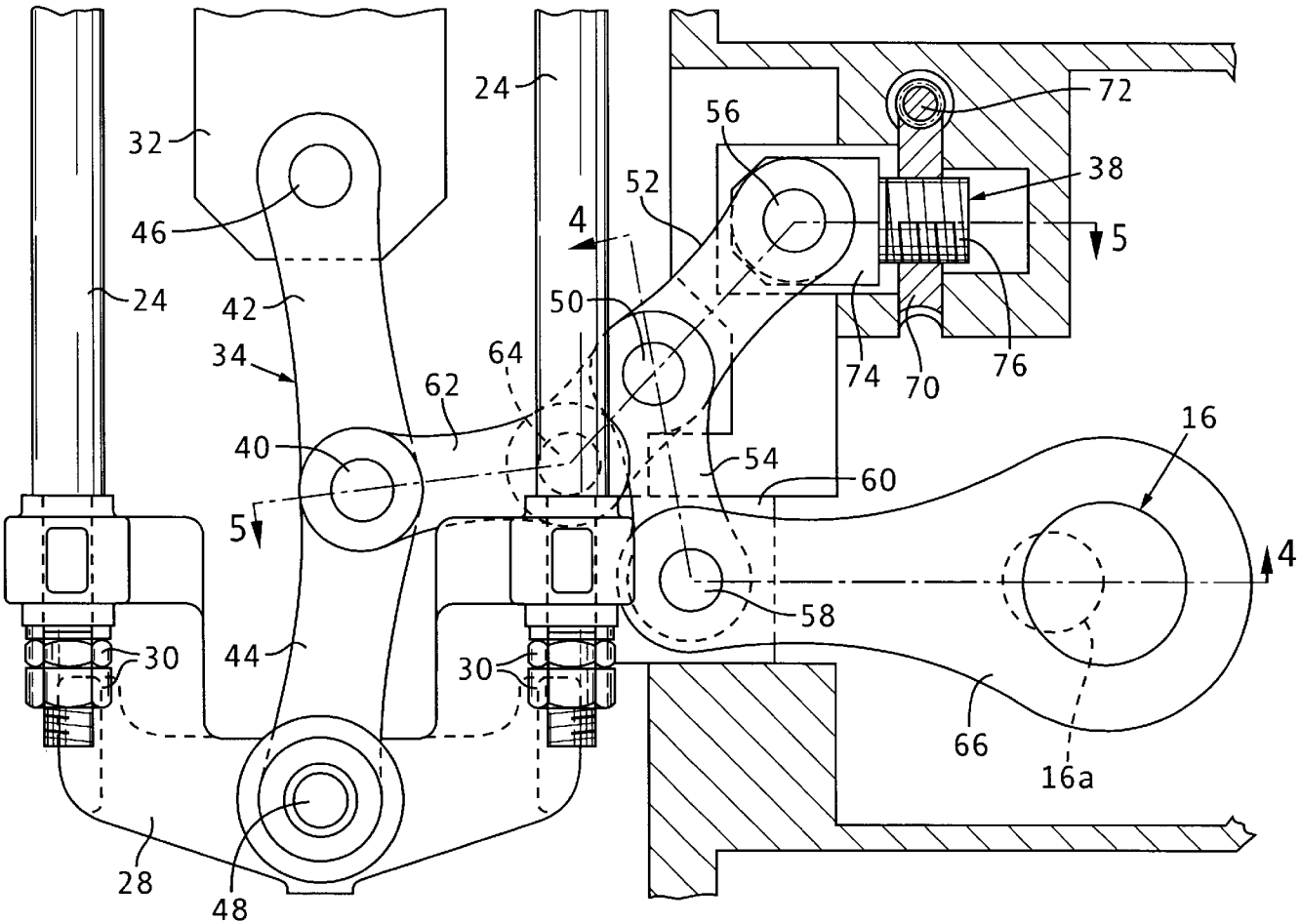
FIG. 3 is a view similar to FIG. 2 showing a driving mechanism and surroundings thereof by enlarging them.
Figure 4:
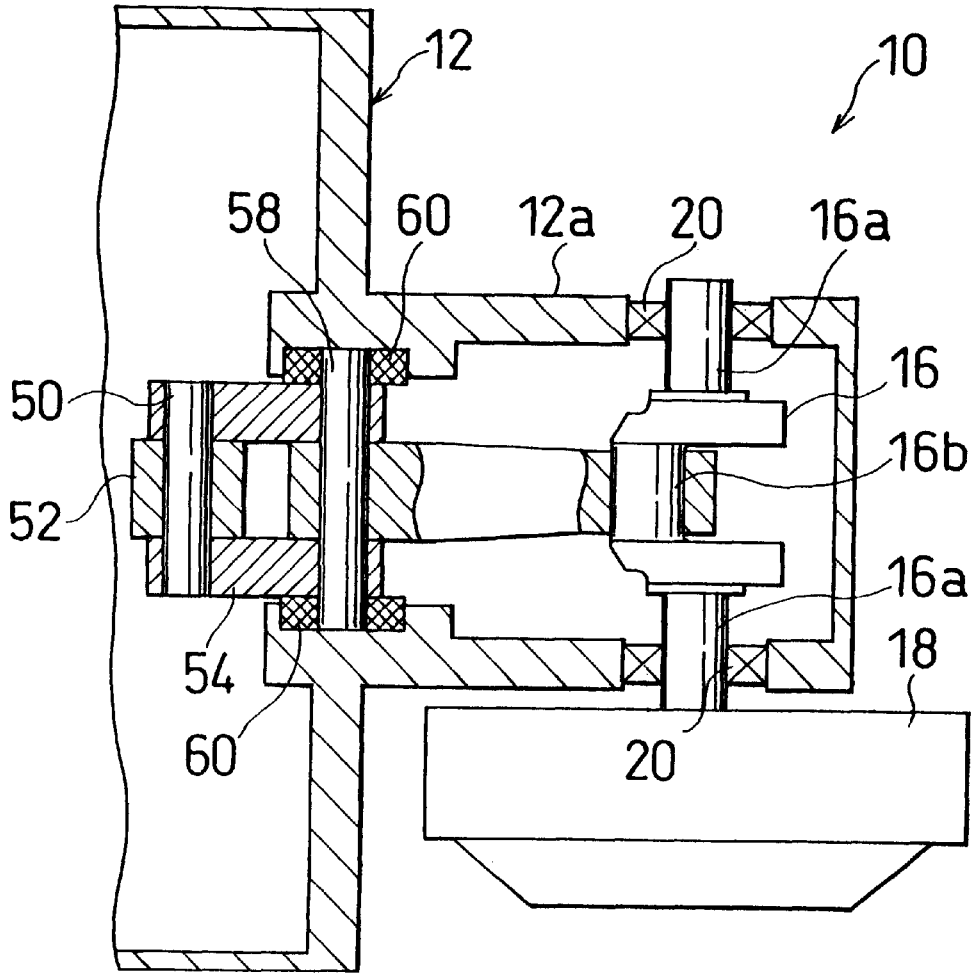
FIG. 4 is a sectional view taken on line 4—4 of FIG. 3.
Figure 5:
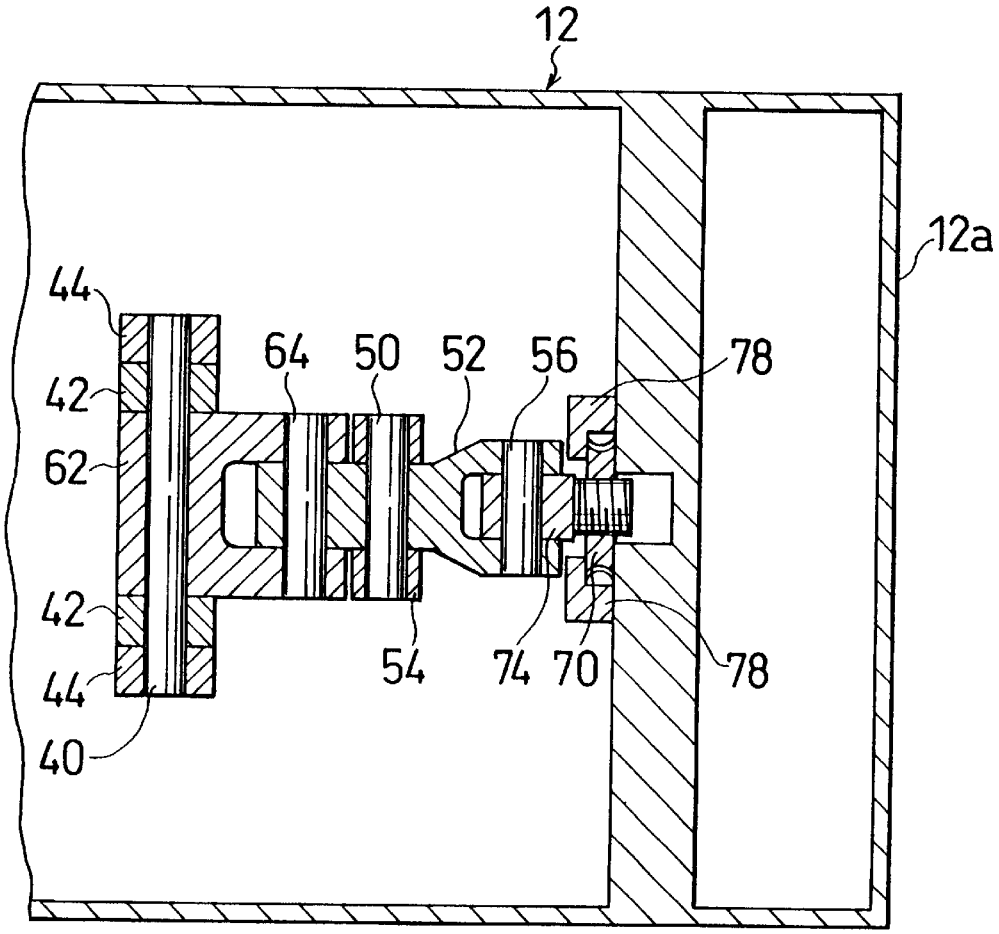
FIG. 5 is a sectional view taken on line 5—5 of FIG. 3.

Referring to FIGS. 1 through 5, a press machine 10 includes a lower frame 12 on which a driving mechanism as will be described later is disposed, and an upper frame 14 supported by the lower frame 12. In the following description, "the right and left directions," in FIG. 1 refers to the direction perpendicular to the drawing carrying FIGS. 2 and 3, and "the front and rear directions" refers to the direction perpendicular to the drawing carrying FIG. 1, in other words, equivalent to the right and left direction in FIGS. 2 and 3.

A crankshaft 16 is supported along an axis horizontally extending through the casing portion 12*a* of the lower frame 12 so as to rotate about that axis. Also, the crankshaft 16 supports, at its one end, a flywheel 18 to which the rotary motion is transmitted from a rotation source such as an electric motor. The crankshaft 16 includes a plurality of principal shaft portions 16*a* supported by the lower frame 12 through a plurality of bearings 20, and an eccentric shaft portion 16*b*. The flywheel 18 is provided with a clutch and a braking mechanism.

An upper slide 22 on which an upper die is set up is fitted to respective upper ends of a plurality of posts 24 vertically extending in parallel, by using a plurality of screw members 26. A a lower slide 28 is fitted to respective lower ends of the posts 24 by using a plurality of screw members 30.

Respective posts 24 penetrate to be movable in the up and down directions through the upper wall 12*b* of the lower frame 12, the base plate portion 14*a* of the upper frame 14, and the boss portion 14*b* of the upper frame 14, and their upper ends are received to be movable in the up and down directions by the upper wall 14*c* of the upper frame 14.

The lower slide 28 is connected, through the first link mechanism 34, with a bracket 32 provided on the upper wall portion 12*b* of the lower frame 12. The link mechanism 34 is pivotally connected, through a connecting mechanism 36, with the eccentric shaft portion 16*b* of the crankshaft 16 and is correspondingly bent and stretched as the crankshaft 16 is rotated. The range of bending-stretching angle of the link mechanism 34 can be adjusted by an adjusting device 38.

The link mechanism 34 includes a pair of levers 42 and 44 pivotally connected with each other through a pivotal rod 40 extending in the right and left directions such that the levers can be bent and stretched. One lever 42 is pivotally connected with the bracket 32 through a shaft or a pivotal rod 46 extending in the right and left directions. The other lever 44 is pivotally connected with the lower slide 28 through a shaft or a pivotal rod 48 extending in the right and left directions.

The pivotal rod 46 functions as a first pivot or a first fulcrum of the link mechanism 34 while the pivotal rod 48 functions as a second pivot or a second fulcrum of the same. The first and second fulcrums exist on a common axis extending in the up and down directions at a distance from each other in the up and down directions. The first fulcrum is positioned above the second fulcrum. However, the link mechanism 34 may be constructed such that the first fulcrum is positioned below the second fulcrum. The first pivot is an unmovable fulcrum not moved by the bending-stretching motion of the levers 42 and 44. The second pivot is a movable fulcrum moved by the bending-stretching motion of the levers 42 and 44.

The connecting mechanism 36 includes another pair of levers 52 and 54 pivotally connected with each other through a shaft or a pivotal rod 50 extending in the right and left directions so as to be bent and stretched. One lever 52 is pivotally connected with the adjusting device 38 through a shaft or a pivotal rod 56 extending in the right and left directions. The other lever 54 is pivotally connected with a pair of sliders 60 through a shaft or a pivotal rod 58 extending in the right and left directions.

These levers 52 and 54 constitute the second link mechanism, and the pivotal rod 56 functions as a third pivot or a third fulcrum of the second link mechanism while the pivotal rod 58 functions as a fourth pivot or a fourth fulcrum of the same. In the second link mechanism, the third fulcrum is also positioned above the fourth fulcrum. However, the positional relation of both pivots may be reversed. The third pivot is an unmovable fulcrum not moved by the bending-stretching motion of the levers 52 and 54. The fourth pivot is a movable fulcrum moved by the bending-stretching motion of the levers 52 and 54.

The levers 62 and 54 are pivotally connected with the first link mechanism 34 at one end of the lever 52 through a lever 62 and a shaft or a pivotal rod 64 extending in the horizontal direction. The slider 60 is set up on the lower frame 12 so as to move in the back and forth directions. The lever 54, the pivotal rod 58 and the slider 60 are pivotally connected with the eccentric shaft portion 16*b* of the crankshaft 16 through a connecting rod 66.

The adjusting device 38 includes a circular plate-shaped rotating body 70 set up in the casing portion 12*a* of the lower frame 12 with the help of a guide or an auxiliary member 78 such that it can rotate about an axis extending in the back and forth directions but can move neither in the right and left directions nor in the up and down directions; a rotating mechanism 72 capable of rotating the circular plate shaped rotating body 70; and a moving body 74 connected with the connecting mechanism 36.

In an example as shown, the rotating body 70 is constituted with a worm wheel having a female-threaded hole at its center. The rotating mechanism 72 is constituted with a worm in mesh with the worm wheel, i.e., the rotating body 70 and is rotatively supported on the lower frame 12 so as to be rotated manually or with an electric motor. The moving body 74 is set up on the lower frame 12 movably in the direction of the rotary axis of the rotating body 70. Furthermore, the moving body 74 is pivotally connected with the lever 52 through the pivotal rod 56. Still further, the moving body 74 includes a male screw portion 76 mating with the female-threaded hole of the moving body 70.

The worm wheel may be replaced by a flat plate-shaped rotating body such as a gear, a ratchet wheel, a sprocket, a timing pulley and the like. Also, depending on the sort of the rotating body, the worm may be replaced by a rotating mechanism including other members such as a ratchet, a chain, a timing pulley, a timing belt and the like.

In the actual use of the press machine 10, the upper die is set up on the upper slide 22 while the lower die is set up on a bolster 80 mounted on the base plate portion 14*a*.

When the crankshaft 16 is rotated, the connecting rod 66 is reciprocated, whereby the lever 54, the pivotal rod 58 and the slider 60 are correspondingly reciprocated. The reciprocating motion of the lever 54 and the pivotal rod 58 is limited by the slider 60 so as to be reciprocated only in the back and forth directions. While the lever 54 and the pivotal rod 58 are reciprocated, the pivotal rod 56 does not move relative to the frame 12. Thus, the reciprocating motion of the lever 54 and the pivotal rod 58 is transmitted, as the motion of pushing and pulling the lever 54, to the second link mechanism including the levers 52 and 54, whereby the levers 52 and 54 perform their bending-stretching motion.

The bending-stretching motion by the levers 52 and 54 is transmitted to the lever 62, thereby reciprocating the lever 62 in the back and forth directions. This reciprocating motion of the lever 62 is further transmitted to the first link mechanism 34 as the motion of pushing and pulling the pivotal joint between the levers 42 and 44.

Figure 6:
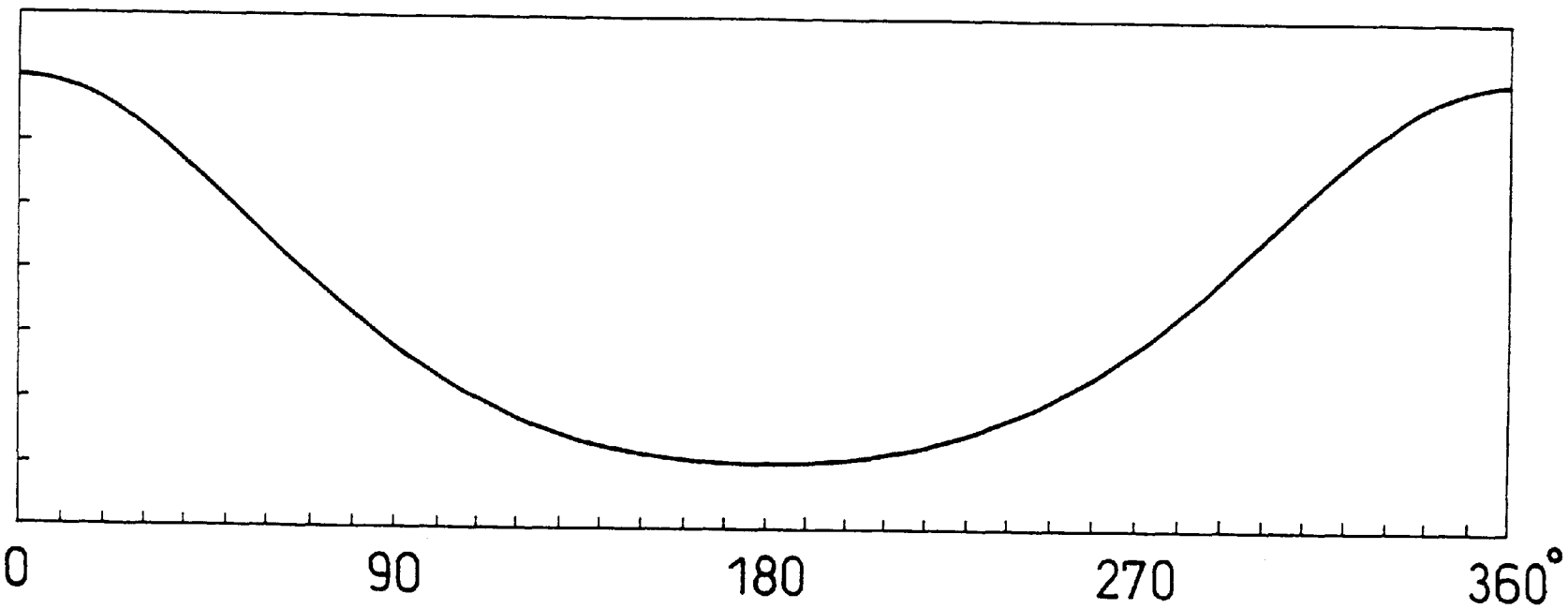
FIG. 6 is a graph indicating a stroke curve of an upper slide.
Figure 7:
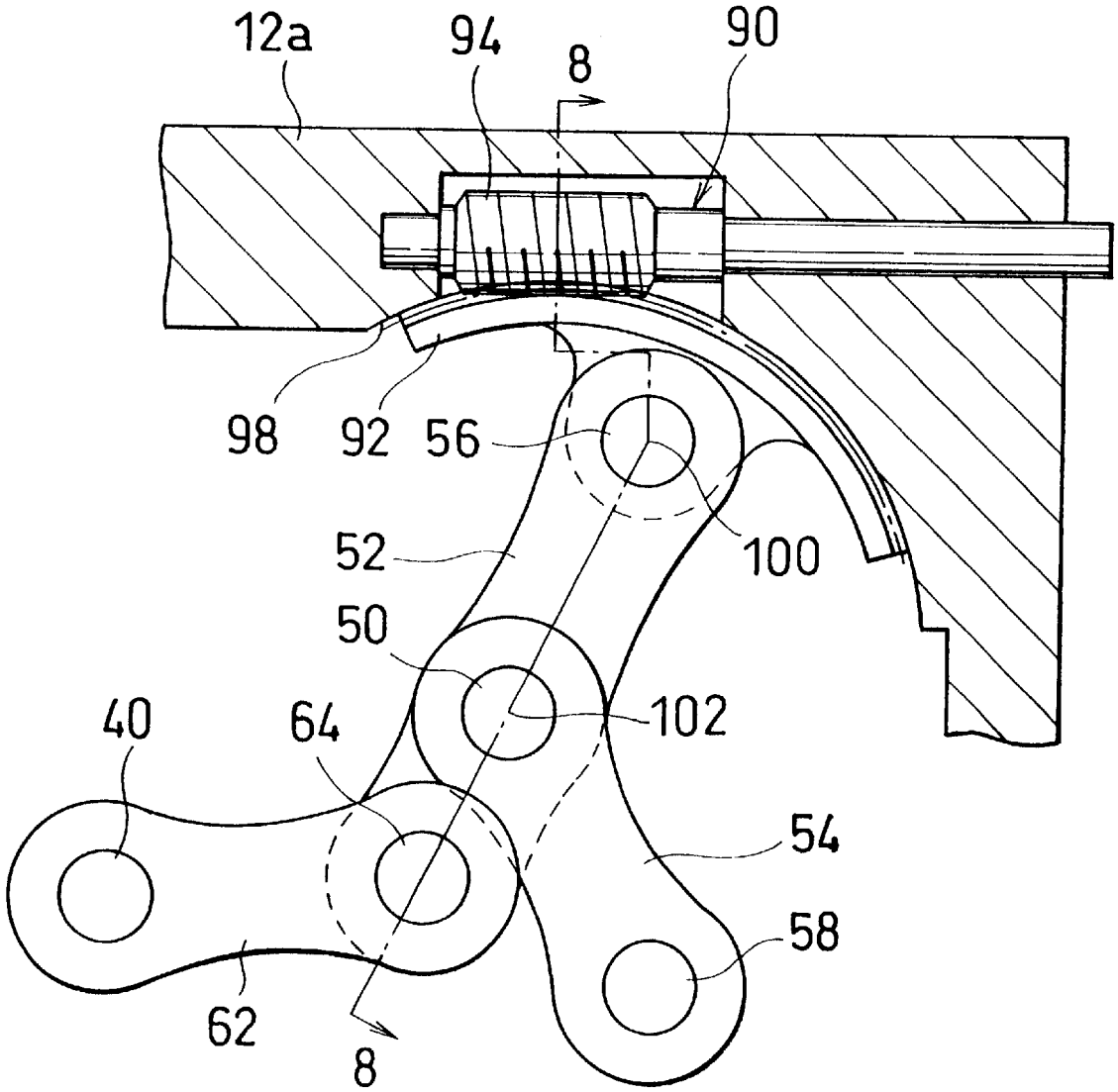
FIG. 7 is another embodiment of an adjusting device according to the invention.
Figure 8:
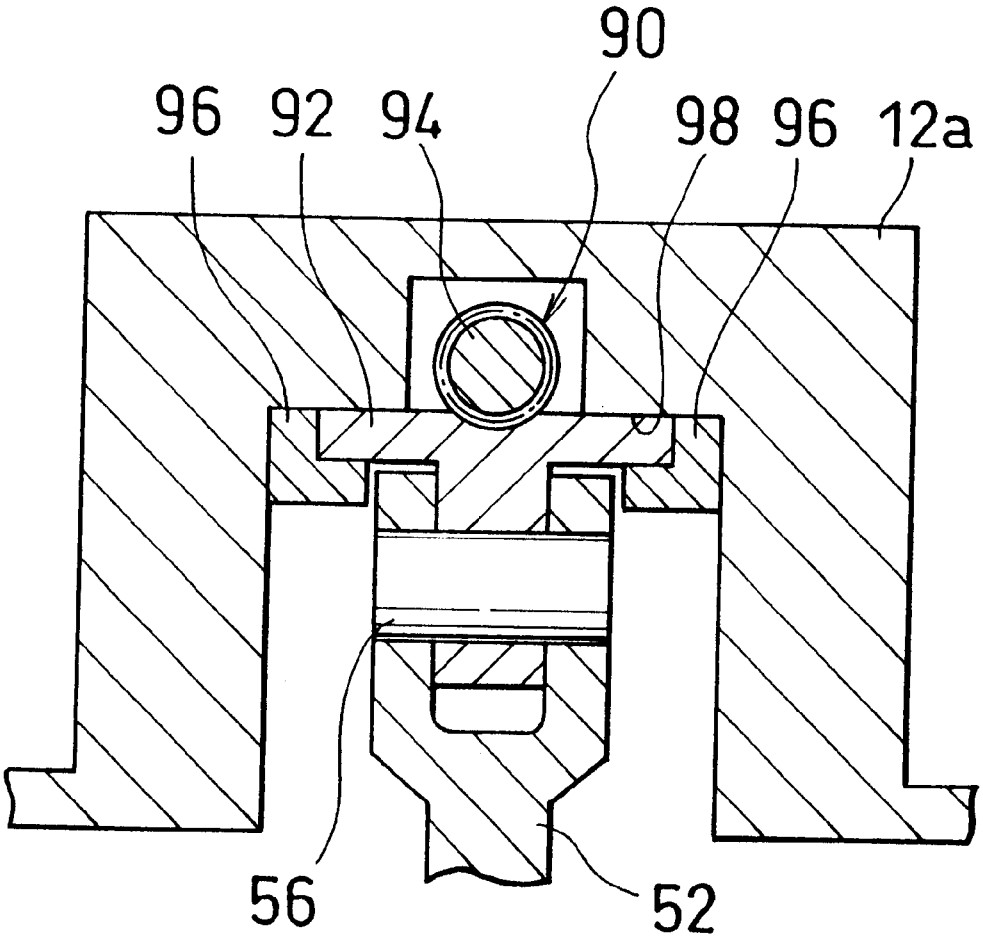
FIG. 8 is a sectional view taken on line 8—8 of FIG. 7.

At this time, as the first fulcrum of the first link mechanism 34 does not move relative to the frame 12, the levers 42 and 44 are bent and stretched about the pivotal rod 40, and the second fulcrum are reciprocated in the up and down directions. With this, the lower slide 28, posts 24 and the upper slide 22 are reciprocated in the up and down directions. FIG. 6 indicates an example of the stroke curve of the upper slide 22.

In the adjusting device 38, the male screw portion 76 of the moving body 74 is mated with the female-threaded hole of the rotating body 70. Therefore, as the rotating body 70 is rotated, the moving body 74 is moved in the back and forth directions, thus moving the pivotal rod 56 of the second link mechanism in the same directions.

As the moving body 74 is moved forward, the pivotal rods 50, 64 and the lever 62 are moved forward, thereby moving the pivotal rod 40 forward. With this, the maximum and minimum bent angles are made larger by levers 42 and 44 as they are bent and stretched in correspondence with the rotation of the crankshaft 16.

Contrary to this, as the moving body 74 is moved backward, the pivotal rods 50, 64 and the lever 62 are moved backward, thereby moving the pivotal rod 40 backward. With this, the maximum and minimum bent angles made by levers 42 and 44 are made smaller as they are bent and stretched corresponding to the rotation of the crankshaft 16.

As mentioned above, if the maximum and minimum bent angles are changed by the levers 42 and 44 as they are bent and stretched, the maximum and minimum intervals between the first fulcrum (pivotal rod 46) and the second fulcrum (pivotal rod 48) of the first link mechanism 34 are correspondingly changed, thus changing the stroke of the upper slide 22. Therefore, it becomes possible to finely adjust the stroke of the upper slide 22.

Assuming, for instance, that both levers 42 and 44 have a constant effective length, a is the effective length of both levers 42 and 44 and θis a bent angle made by both levers 42 and 44, the interval X between the first and second fulcrums of the first link mechanism 34 can be expressed by the following equation (1).

$$X=2a\cdot\sin(\theta/2) \tag{1}$$

Therefore, the smaller the maximum and minimum bent angles made by levers 42 and 44 during their bending-stretching motion are, the larger the interval X between the first and second fulcrums of the first link mechanism 34 and the stroke of the upper slide 22 become.

In other words, the stroke of the upper slide 22 can be made larger by advancing the moving body 74 forward while it can be made smaller by pulling the moving body 74 backward. However, the most allowable advanced position of the moving body 74 is preset such that the bent angle θ is less than 180°.

As described above, if the angular range of the bending-stretching motion of the first link mechanism 34 is adjusted by means of the adjusting device 38, the stroke of the upper slide 22 can be adjusted so as to meet the sort of press processing. Also, if the angular range of the bending-stretching motion of the first link mechanism 34 is changed, the moving speed of the upper slide 22 is changed in the vicinity of the upper and lower dead points, so that the moving speed of the upper slide 22 especially in the vicinity of the lower dead point can be adjusted so as to comply with the sort of the press processing.

Figure 9:
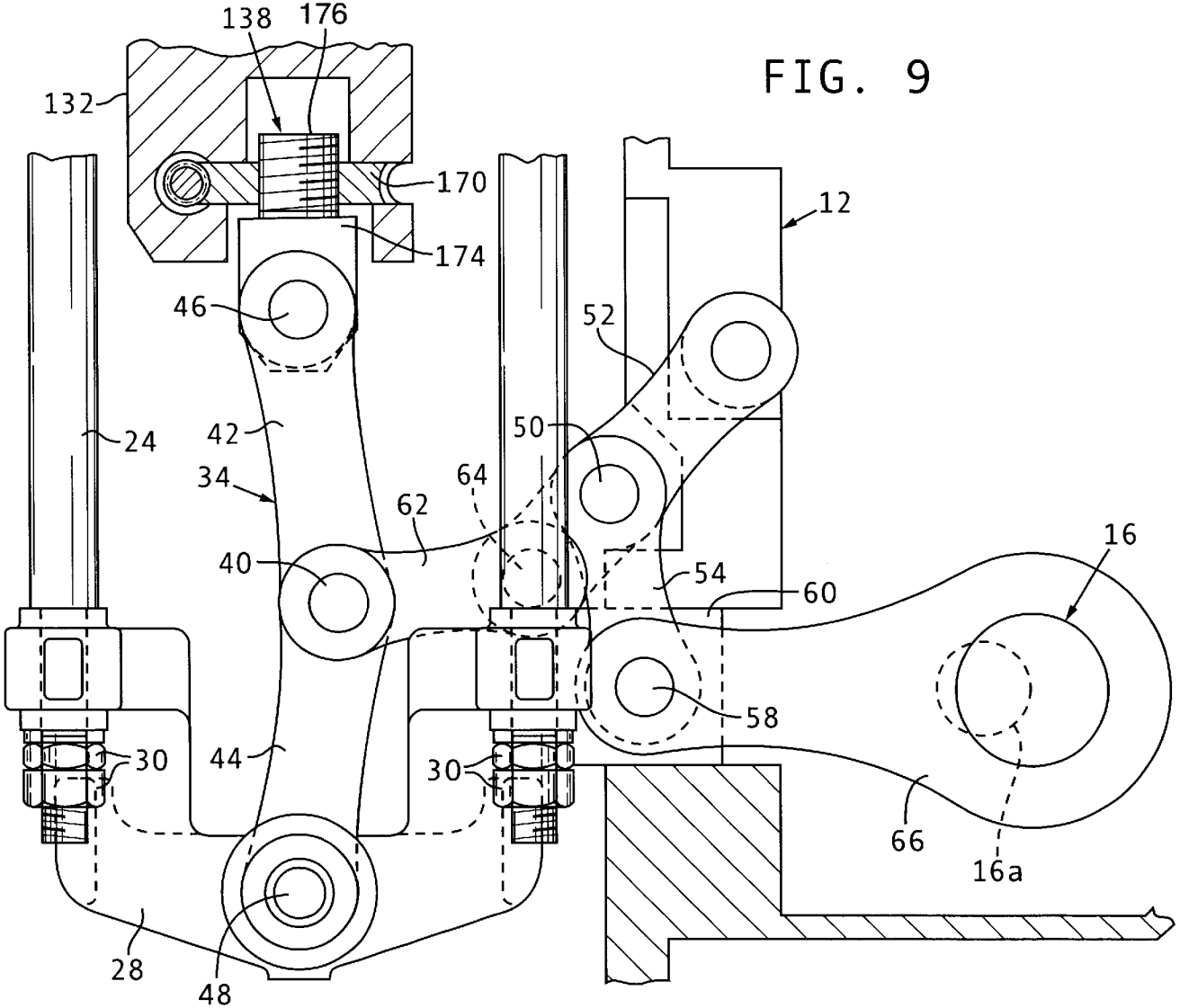
FIG. 9 is a sectional side view of the frame showing and alternative embodiment.

In the embodiment as described above, there is employed such a structure that the moving body 74 is moved back and forth by rotating the rotating body 70. However, the moving body 74 may be moved back and forth by using the other member. Furthermore, it is possible to adopt such a structure as the vertical position of the first fulcrum of the first link mechanism 34 can be adjusted by using the adjusting device 38. This is shown in FIG. 9, where the adjusting device 138 is mounted to the frame bracket 132, and the first fulcrum 46 is pivotally attached to the moving body 174 so that rotation of the rotating body 170 changes the vertical position of the first fulcrum of the first link mechanism 34. Still further, instead of rotating the crankshaft through the flywheel, it is possible to rotate the crankshaft directly by an electric motor such as a servo motor or through a suitable means such as a decelerating device.

As the adjusting device for adjusting the angular range of bending-stretching motion, another mechanism using a member other than the rotating body having a threaded hole may be employed.

Now, referring to FIGS. and 8, a position adjusting mechanism or an adjusting device 90 includes a fan or arc-shaped rotating body 92 pivotally connected with the lever 52 of the connecting mechanism 36 through the pivotal rod 56, and a rotating mechanism 94 for rotating a rotating body 92. In the example as shown, the rotating body 92 is constituted with an external gear while the rotating mechanism 94 is constituted with a worm in mesh with the external gear, i.e., the rotating body 92.

The rotating body 92 is fitted to the casing portion 12*a* of the lower frame 12 with the help of a plurality of arc-shaped guides, i.e., auxiliary members 96 such that the center 101 of its rotary motion is located on an imaginary line connecting the axis 102 of the pivotal rod 50 with the axis 100 of the pivotal rods 56. The worm, i.e., the rotating body 94 is rotatively supported by the casing portion 12*a* and can be rotated manually and/or by the electric motor.

In the embodiment as shown, the rotation center 101 of the rotating body 92 is located between axes 100 and 102. However, the rotation center of the rotating body 92 may be located on the extension of the above imaginary line connecting the axis 102 with the axis 100, or may be positioned on the axis 102 or at a point in the vicinity thereof.

The rotating body 92 has an external peripheral surface extending zonally. On this peripheral surface, there are provided a plurality of gear teeth along the center line running through the mid-width of the peripheral surface and are to be in mesh with the rotating mechanism 94. Both side edge portions of the external peripheral surface are brought into contact with the arc-shaped inner face 98 of the casing portion 12*a* and auxiliary members 96 as well.

In the adjusting device 90, as the rotating mechanism 94 is rotated, the rotating body 92 is angularly moved along the arc-shaped inner face 98 and the auxiliary members 96. Consequently, the pivotal joint 100 pivotally connecting the lever 52 with the rotating body 92 is angularly moved along an imaginary arc.

As a result, since the first fulcrum of the second link mechanism is moved in the same manner, there is changed the range of the bent angle made by levers 52 and 54 as they are bent and stretched with the rotation of the crankshaft, whereby the stroke of the slide motion in the up and down directions is changed. Therefore, the stroke of the slide motion in the up and down directions can be finely adjusted by rotating the rotating mechanism 94.

In the adjusting device 90, in case the center of the radius of curvature of the rotating body 92, the arc shaped inner face 98 and the auxiliary member 96 (i.e., the rotation center of the rotating body 92) is located at the joint center of the levers 52 and 54 (i.e., the axis of the pivotal rod 50) or at a point in the vicinity thereof, and the slide is set at the lower dead point, if the rotating body 92 is angularly rotated by the driving mechanism 94, the rotating body 92 is angularly rotated about the axis 102 or another axis in the vicinity thereof by the rotating mechanism 94, and the joint center 100 between the lever 52 and the external gear 92 are moved in the same manner.

With this, the swinging position and the swinging angle of the levers 52 and 54 are changed as they are bent and stretched corresponding to the rotation of the crankshaft. However, hardly any change is caused not only in the position of the joint 102 between the levers 52 and 54 but also in the position of the lower dead point of the slide. As a result, it becomes possible not only to finely adjust the stroke of the slide motion in the up and down directions but also to keep the position of the lower dead point almost unchanged even if the stroke is changed.

Contrary to the above, in case the rotation center of the rotating body 92 is located apart from the axis 102, if the rotating body 92 is angularly rotated by the rotating mechanism 94, the rotating body 92 is angularly rotated about the axis 102 or another axis in the vicinity thereof, and the axis 100 is angularly moved in the same or opposite direction. As a result, it becomes possible not only to finely adjust the stroke of the slide motion in the up and down directions, but also to make the positional change of the lower dead point smaller even if the stroke is changed.

In the adjusting device 90, the external gear may be replaced by the other flat plate shaped rotating body such as an internal gear, a ratchet wheel, a sprocket, a timing pulley and the like. Also, depending on the sort of the rotating body, the worm may be replaced by a rotating mechanism including other members such as a small gear, a ratchet, a chain, a timing pulley, a timing belt and the like.

The invention is not limited to the embodiments as described in the above. For instance, the invention is applicable to a press machine provided with a balancing weight. Therefore, it will be apparent to those skilled in the art that changes and modifications can be made without departing from the principle and spirit of the invention and the scope as defined in the appended claims.

What is claimed is:

1. A press machine comprising a frame;

a plurality of posts mounted to the frame for movement relative to the frame;

an upper slide fitted to upper end portions of said posts;

a lower slide fitted to lower end portions of said posts;

a crankshaft rotated by a driving source;

a link mechanism having first and second levers pivotally connected with each other about a joint so as to perform bending and stretching motions about that joint through a range, one of said levers having a first fulcrum connected with said frame, the first fulcrum being immovable by the bending-stretching motion, and the other lever having a second fulcrum connected with the lower slide, the second fulcrum and connected lower slide being movable by the bending-stretching motion;

a connecting mechanism for connecting said crankshaft with said link mechanism so as to have the first and second levers bent and stretched as said crankshaft is rotated; and an adjusting device supported by the frame and connected by the connecting mechanism to said link mechanism and movable relative to the frame so as to adjust the range of the bending and stretching motions made by said first and second levers.

2. A press machine as claimed in claim 1, wherein said adjusting device includes circular plate shaped rotating body mounted to the frame for rotation about a central axis of a threaded hole in the body;

a rotating mechanism for rotating said rotating body; and a moving body having a male screw portion mating with said threaded hole, the moving body being connected with said link mechanism.

3. A press machine as claimed in claim 1, wherein said adjusting device includes a rotating body pivotally connected with said connecting mechanism to move relative to the frame along an arc-shaped path; and a rotating mechanism for rotating said rotating body.

4. A press machine as claimed in claim 1, wherein said connecting mechanism includes third and fourth levers pivotally connected at a joint with each other so as to be bent and stretched about that joint, one of said third and fourth levers being connected with said adjusting device;

a connecting member connecting an eccentric shaft portion of said crankshaft with the other of said third and fourth levers such that said third and fourth levers are bent and stretched as said crankshaft is rotated; and a fifth lever for connecting said third and fourth levers with said link mechanism such that said first and second levers are bent and stretched as said third and fourth levers are bent and stretched.

5. A press machine as claimed in claim 4, wherein said connecting mechanism further includes a slider arranged on said frame so as to move in a reciprocating fashion and is connected with the connecting member.

6. A press machine as claimed in claim 1, wherein said adjusting device includes a rotating body pivotally connected with said connecting mechanism, and a rotating mechanism for rotating said rotating body;

wherein said connecting mechanism includes third and fourth levers pivotally connected at a joint axis with each other so as to be bent and stretched about that joint axis, at least one of said levers being pivotally connected with said rotating body;

a connecting rod for connecting an eccentric shaft portion of said crankshaft with the other of said third and fourth levers such that said third and fourth levers are bent and stretched as said crankshaft is rotated, and a fifth lever connecting said third and fourth levers with said link mechanism such that said first and second levers are bent and stretched as said third and fourth levers are bent and stretched; and wherein the rotating body has a rotational center about which said rotating body rotates, the rotational center being substantially coaxial with said joint axis.

7. A press machine as claimed in claim 1, wherein the first and second fulcrums of said link mechanism are positioned so as to keep a certain interval therebetween and thus limit the amount of stretching motion.

8. A press machine as claimed in claim 1, wherein said first fulcrum is positioned above said second fulcrum and between the upper slide and the lower slide.

9. A press machine as claimed in claim 1 further including a bolster mounted to the frame between the upper slide and the lower slide.

10. A press machine as claimed in claim 1, wherein said adjusting device includes a rotating body pivotally connected with said connecting mechanism, and a rotating mechanism for rotating said rotating body;

wherein said connecting mechanism includes third and fourth levers pivotally connected at a joint axis with each other so as to be bent and stretched about that axis, at least one of said levers being pivotally connected with said rotating body;

a connecting rod for connecting an eccentric shaft portion of said crankshaft with the other of said third and fourth levers such that said third and fourth levers are bent and stretched as said crankshaft is rotated, and a fifth lever connecting said third and fourth levers with said link mechanism such that said first and second levers are bent and stretched as said third and fourth levers are bent and stretched; and wherein the rotating body has a rotational center about which said rotating body rotates, the rotational center being spaced from said joint axis.

11. A press machine as claimed in claim 1, wherein said adjusting device includes a rotating body mounted to the frame to move in an arc and pivotally connected with said link mechanism; and a rotating mechanism for rotating said rotating body.

12. An adjustable-stroke press machine comprising:

a frame;

a slide mounted to the frame for linear sliding movement through a stroke distance relative to the frame;

a link mechanism having a first fulcrum pivotally fixed to the frame and a second fulcrum pivotally attached to the slide to move with the slide, the link mechanism also having a central pivot joint located at an adjustable position relative to the first and second fulcrums and about which pivot joint the link mechanism bends and stretches through an angular range that corresponds to the stroke distance;

a crankshaft connected by a connecting mechanism to the link mechanism and rotatable for reciprocally bending and stretching the link mechanism through the angular range;

an adjusting device interconnected between the frame and the connecting mechanism and selectively operable for adjusting the position of the central pivot joint of the link mechanism, thereby to change the angular range and the corresponding stroke distance; and first and second connecting lever pivotally connected together at a common joint, an outer end of the first lever away from the common joint being pivotally connected to the frame at an adjustable location relative to the frame, and an outer end of the second lever away from the common joint being mounted for sliding motion relative to the frame;

a link lever connected between the link mechanism and the first and second connecting levers to transmit motion between the link mechanism and the connecting levers;

wherein the crankshaft is connected to the sliding outer end of the second lever and the adjusting device is connected to the outer end of the first lever such that operation of the adjusting device changes the adjustable location of the outer end of the first lever, which change is transmitted via the link lever to adjust the position of the central pivot joint of the link mechanism and wherein the adjusting device is configured so that the location of the outer end of the first lever is changed along an arc-shaped path.

13. The press machine of claim 12 wherein the sliding outer end of the second lever is constrained for movement along a linear direction that is substantially perpendicular to the linear sliding movement of the slide.

* * * * *